US005144941A

United States Patent [19]

Saito et al.

[11] Patent Number: 5,144,941

[45] Date of Patent: Sep. 8, 1992

[54] COMBUSTION SYSTEM FOR SUPPRESSING EMISSION OF GASES BELIEVED TO CAUSE GREEN-HOUSE-EFFECT

[75] Inventors: Toshihiko Saito, Tokyo; Kazuo Saito, Fujisawa, both of Japan

[73] Assignee: Kabushiki Kaisha Toshiba, Kawasaki, Japan

[21] Appl. No.: 677,464

[22] Filed: Mar. 29, 1991

[51] Int. Cl.[5] ..... F24B 1/191

[52] U.S. Cl. ..... 126/507; 126/512; 126/110 R; 110/203; 110/211; 431/350

[58] Field of Search ..... 431/353, 8, 10, 350; 126/99 R, 110 R, 108, 109, 112, 83, 512, 507; 110/203, 204, 210, 211, 213, 216

[56] References Cited

U.S. PATENT DOCUMENTS

| | | | |
|---|---|---|---|
| 3,043,246 | 7/1962 | Hebert | 110/211 |
| 3,043,249 | 7/1962 | Hebert et al. | 110/211 |
| 3,742,874 | 7/1973 | Eff | 110/216 X |
| 4,628,898 | 12/1986 | Von Conta | 110/213 X |
| 4,646,712 | 3/1987 | Ferguson et al. | 110/211 X |
| 4,675,029 | 6/1987 | Norman et al. | 110/216 X |
| 4,854,298 | 8/1989 | Carver | 110/211 X |

*Primary Examiner*—Larry Jones

*Attorney, Agent, or Firm*—Oblon, Spivak, McClelland, Maier & Neustadt

[57] ABSTRACT

A toxic gas exhaust suppression-type combustion system burns a hydrocarbon-based fuel and comprises, an incomplete combustion section for causing incomplete combustion by supplying the fuel and a small amount of air, a solid component removing section, connected to said incomplete combustion section, for collecting and removing a solid component, such as soot, within an unburned gas generated by said incomplete combustion section, and a complete combustion section for perfectly burning a remaining unburned gas by supplying a sufficient amount of air, the remaining unburned gas being obtained by removing the solid component from the unburned gas generated by said incomplete combustion section by flowing the unburned gas through said solid component removing section.

9 Claims, 8 Drawing Sheets

COMBUSTION SYSTEM FOR SUPPRESSING EMISSION OF GASES BELIEVED TO CAUSE GREEN-HOUSE-EFFECT

BACKGROUND OF THE INVENTION

1. Field of the Invention

The present invention relates to a combustion system for burning a hydrocarbon-based fuel while suppressing exhaust of gases believed to cause green-house-effect such as carbon dioxide.

2. Description of the Related Art

Several global environmental issues such as an increase in carbon dioxide concentration in air have recently been discussed. When carbon dioxide in air is increased, warming of the earth's climate is promoted, resulting in increase in desert area or sea level elevation. If no countermeasure is taken very soon, a serious environmental disruption might be caused.

The sources for generating carbon dioxide can be classified into a natural source accompanying animal activities and an artificial source accompanying use of vehicles or boilers. Recent abnormal increase in carbon dioxide concentration is said to be caused mainly by the artificial source, especially use of combustion systems.

However, exhaust of carbon dioxide from combustion systems is inevitable as far as a carbon-containing fuel (hydrocarbon-based fuel) is used. When coal, that contains carbon as its main component, is used as the fuel, exhaust amount of carbon dioxide cannot be reduced.

Exothermic reactions of hydrocarbon based fuels such as petroleum and a natural gas include one caused by oxidation of carbon and the one caused by hydrogen. Hence, if carbon components can be separated from a hydrocarbon-based fuel, generation of carbon dioxide can be prevented, as in a case of a hydrogen fuel.

It is, however, very difficult in terms of technology to separate only carbon components from the hydrocarbon-based fuel. For this reason, studies have been recently eagerly made on a combustion system using a hydrocarbon-based fuel to increase the thermal efficiency, thereby obtaining a necessary carolific value with a minimum fuel consumption. However, e.g., a current home boiler using a hydrocarbon-based fuel already has a high thermal efficiency of 80% or more. Even if a thermal efficiency of more than 90% is realized, it will only decrease the exhaust amount of carbon dioxide by as little as a maximum of 10%. Accordingly, improvement in thermal efficiency of a combustion system can hardly decisively solve the problem of carbon dioxide. Similarly, boilers for industrial use or for power plant that use a hydrocarbon-based fuel already have a thermal efficiency of 90% or more. Therefore, it is difficult to further improve the thermal efficiency.

As described above, with a conventional combustion system that uses a hydrocarbon-based fuel, exhaust of carbon dioxide is inevitable. Even if the thermal efficiency of the system is improved to suppress exhaust of carbon dioxide, it will be expected to suppress exhaust as little as a maximum of 10%. Therefore, the problem of realizing drastic exhaust suppression of carbon dioxide cannot be solved with a conventional system that aims at improvement in thermal efficiency.

SUMMARY OF THE INVENTION

It is an object of the present invention to provide a combustion system that can realize exhaust suppression of a toxic gas such as carbon dioxide by using a hydrocarbon-based fuel and without employing a complicated method or arrangement, thus contributing to preservation of environment.

In order to achieve the above object, the combustion system according to the present invention comprises the following steps.

(1) To cause primary combustion of a hydrocarbon-based fuel at an excess air ratio of less than 1.0. Since the primary combustion is incomplete combustion, soot is generated.

(2) To collect soot from the unburned gas generated by the primary combustion.

(3) To cause secondary combustion of the unburned gas, from which soot is removed, at an excess air ratio of 1.2 or more, thus performing complete combustion.

(4) To collect heat generated by the primary and secondary combustions by an appropriate means.

FIG. 1 shows a case wherein, e.g., kerosene as a typical hydrocarbon-based fuel is burned in the above combustion process sequence. For burner spray, it is preferable to use a burner having poor characteristics of atomization and poor characteristic of spray so that soot is easily generated. For dust collection, it is preferable to employ both an electric dust collecting method and a cyclone dust collecting method. Then, soot of carbon particles ranging from liquid drop decomposition-based carbon soot having a large particle size to carbon of a soot pattern in gas phases having a small particle size can be effectively collected. Furthermore, when a fuel gas is used, it is preferable to cause primary combustion with a non-whirling long flame so that soot is easily generated.

A case will be described wherein kerosene is used as the fuel. The reaction combustion formula of the primary combustion according to the present invention is expressed as follows:

$$C_{12}H_{24}+18\lambda O_2 \rightarrow \lambda(12\alpha CO+6\beta O_2+12\gamma H_2O)$$

where $\gamma$ is the excess air ratio, $\alpha$ is the CO conversion rate, and $\beta$ and $\gamma$ are coefficients that change in accordance with a change in $\alpha$. When the excess air ratio $\lambda$ is 1, $\alpha$ is 1, and the carbon component contained in the fuel is entirely converted into CO (carbon monoxide). When the excess air ratio $\lambda$ becomes smaller than 1, the conversion rate c also becomes smaller than 1 (1.0).

In the combustion system of the present invention, the excess air ratio $\lambda$ is set smaller than 1 to perform primary combustion. Hence, the conversion rate $\alpha$ is smaller than 1. As a result, most of the carbon component contained in the fuel becomes soot, and the balance becomes carbon monoxide. In other words, a relationship shown in FIG. 11 is found between the excess air ratio $\lambda$ and the generation amount of soot. The smaller the excess air ratio $\lambda$, that is, the less complete the combustion, the larger the soot generation amount.

The soot is collected and kept not to influence combustion. Meanwhile, carbon monoxide is subjected to secondary combustion with an excess air ratio of 1.2 or more. The amount of carbon monoxide subjected to secondary combustion is largely smaller than that of a case where carbon monoxide is subjected to primary combustion with an excess air ratio of 1. Therefore, the amount of carbon dioxide generated by the secondary combustion is sufficiently small, and accordingly the exhaust amount of carbon dioxide can be suppressed. It is apparent that if all the carbon component contained in the fuel is collected in the form of soot, the same result as that when a hydrogen fuel is used can be obtained with the hydrocarbon-based fuel.

According to the combustion system of the present invention, most of the carbon component contained in the fuel is collected in the form of soot. Therefore, the thermal efficiency inevitably suffers from energy economization to a certain degree. However, since the soot becomes luminous flame in the flame during the primary combustion and radiant heat from the luminous flame is expected, the low thermal efficiency can be compensated for to a certain degree. Since the primary combustion is incomplete combustion and the combustion temperature is low, generation of nitrogen oxides ($NO_x$) is minimized. In the secondary combustion, the excess air ratio $\lambda$ is set low to satisfy the relationship described above. Therefore, the combustion temperature is low. As a result, generation of nitrogen oxides is minimized in the secondary combustion as well. Thus, according to the system of the present invention, generation of nitrogen oxides can also be minimized.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
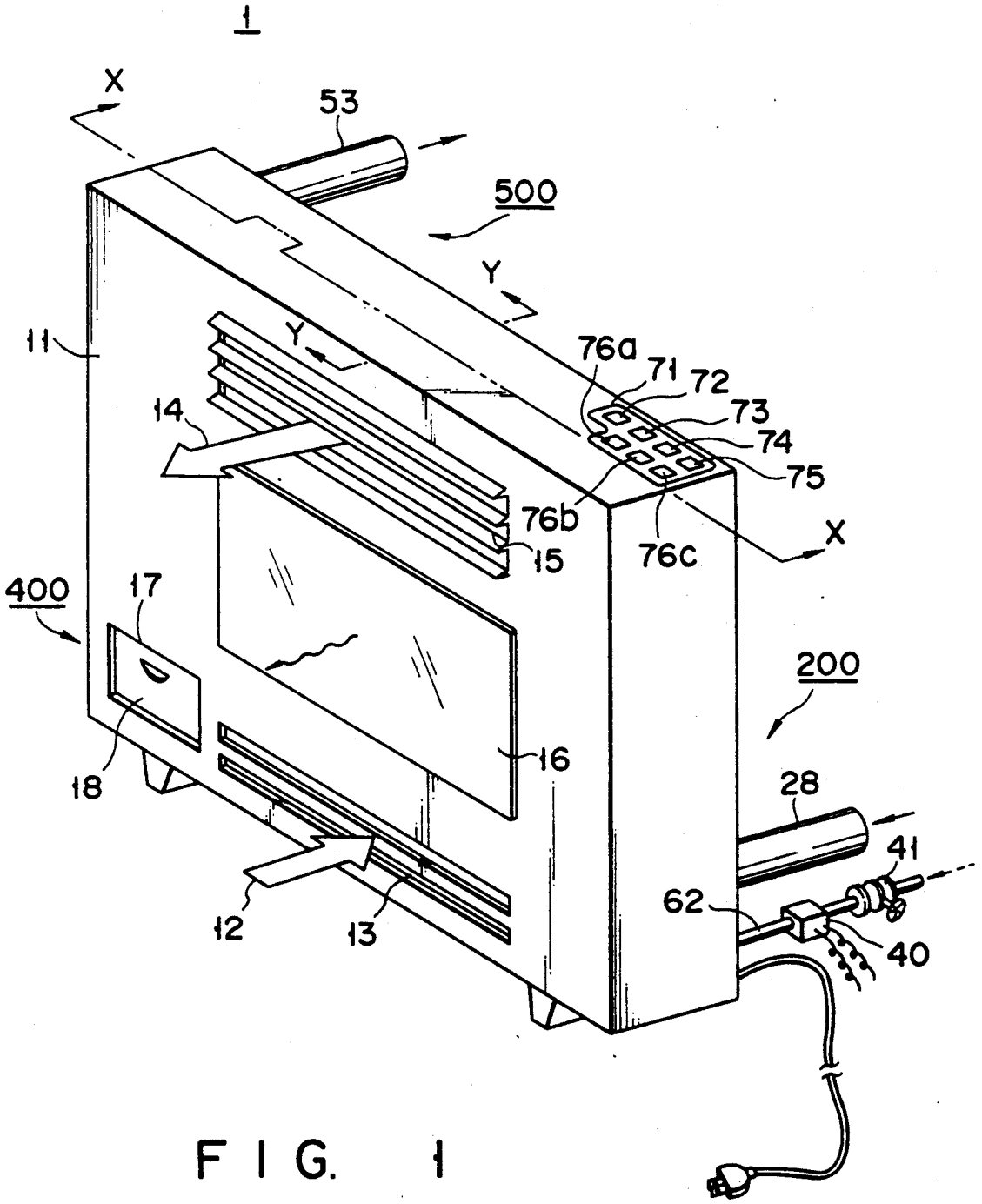
FIG. 1 is a perspective view showing a room heater which is a combustion system according to the first embodiment of the present invention.

FIG. 1 is a perspective view of a room heater 1 as a combustion system according to an embodiment of the present invention. The room heater 1 is a type of a fan heater stove which uses kerosene as the fuel. The function and structure of the room heater 1 are briefly shown in FIGS. 2 and 3 that show the embodiment of the present invention.

Figure 2:
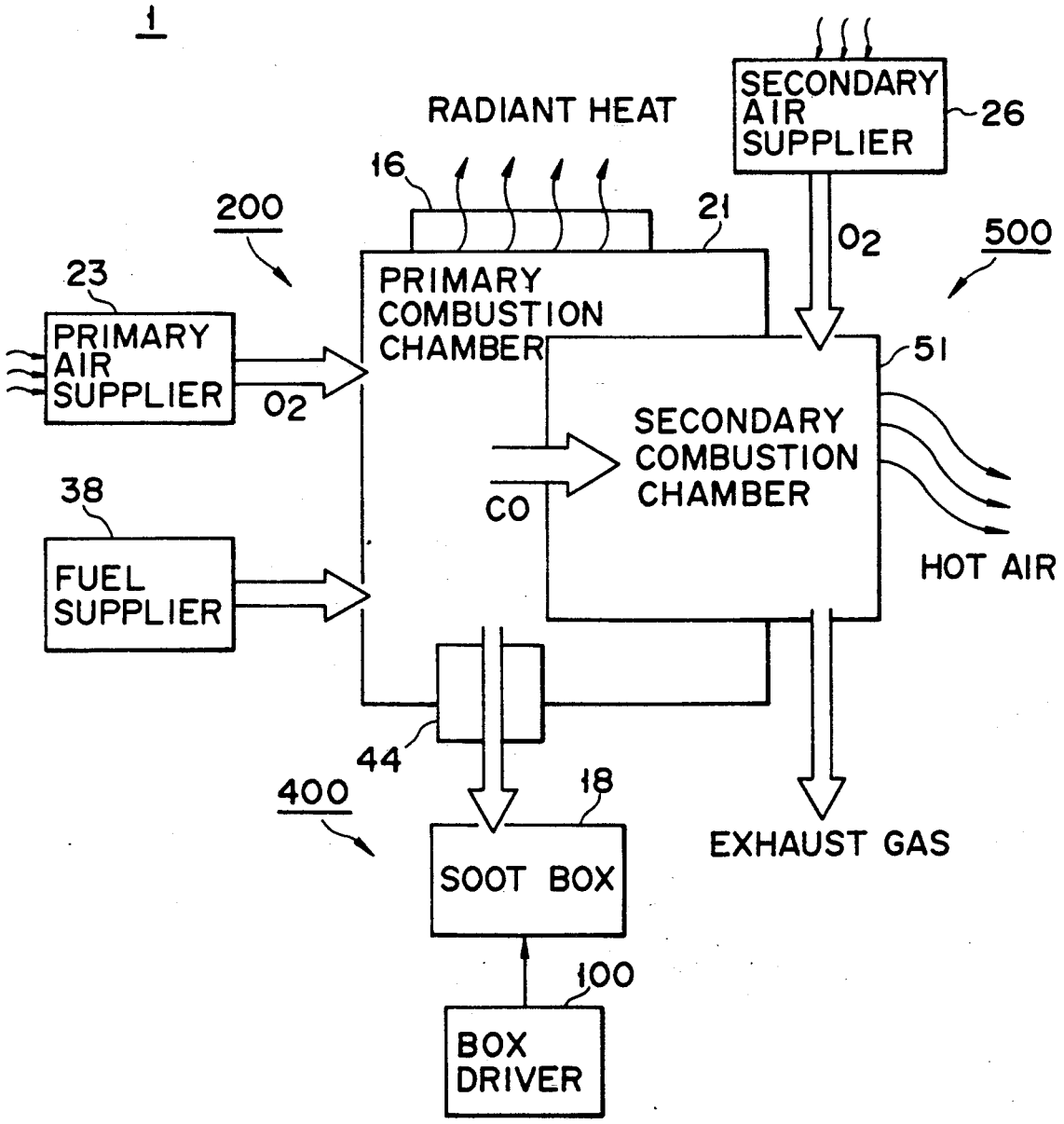
FIG. 2 and FIG. 3 are functional block diagrams of the combustion system according to the first and the second embodiment of the present invention.
Figure 3:
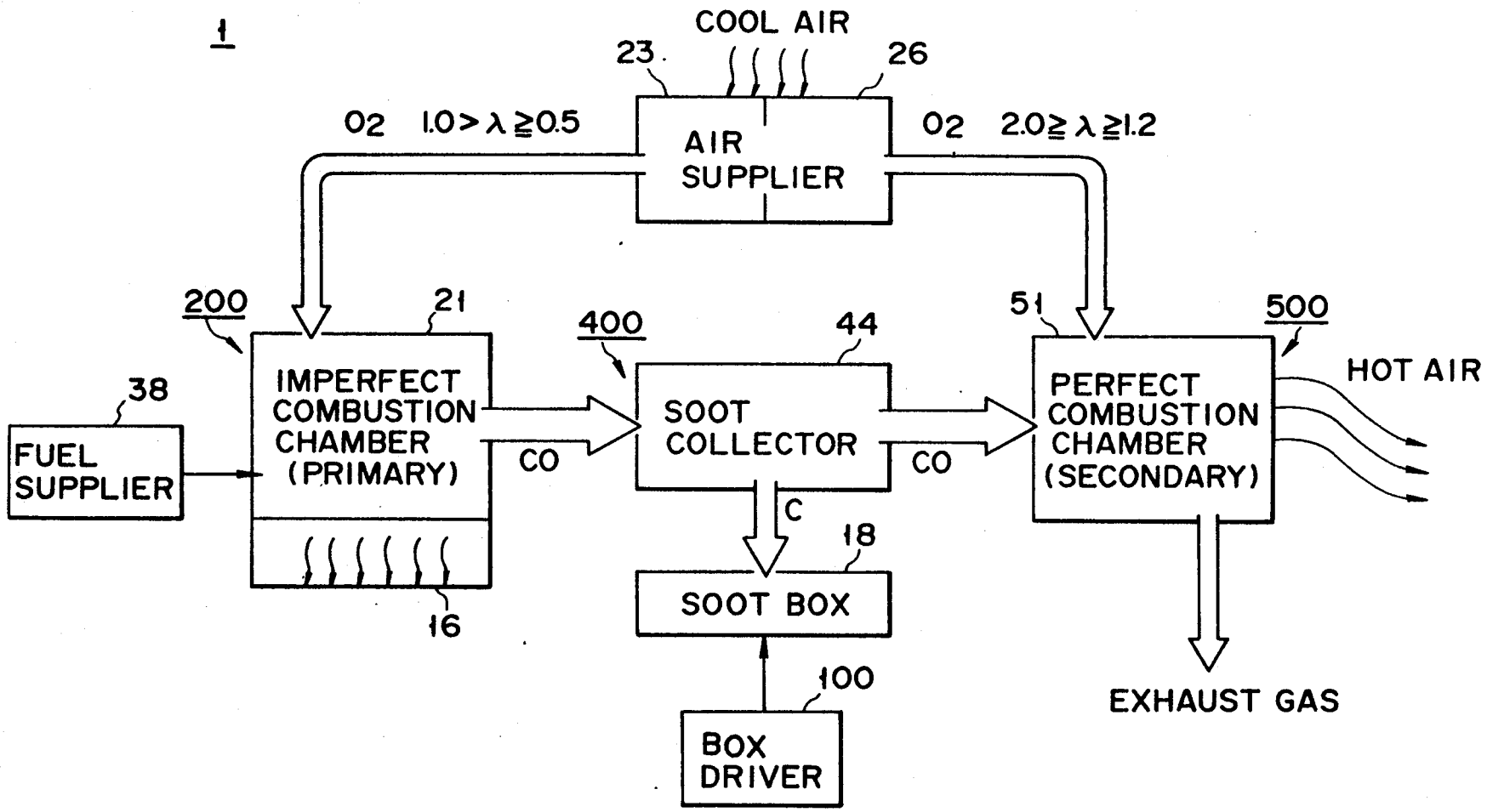

More specifically, the room heater 1 shown in FIGS. 2 and 3 roughly has the following three functional blocks:

(1) an incomplete combustion functional block 200 for performing incomplete combustion by supplying air to burn a hydrocarbon-based fuel;

(2) a solid component removing functional block 400, connected to the incomplete combustion functional block, for removing a solid component in the unburned gas which is generated by the incomplete combustion block; and (3) a complete combustion functional block 500, connected to the solid component removing functional block, for perfectly burning the remaining unburned gas, obtained by removing the solid component by the solid component removing functional block, by supplying sufficient air.

In other words, the incomplete combustion functional block 200 comprises a primary combustion chamber 21 having a predetermined size, a primary air supplier 23 for supplying air to the combustion chamber 200, and a fuel supplier 38 for supplying kerosene to the combustion chamber 21, and intentionally performs incomplete combustion.

The solid component removing functional block 400 following the block 200 comprises a soot collector 44 for collecting soot as the solid component from the unburned gas, a soot box 18 for accumulating and recovering the collected soot, and a box driver 100 for selectively moving the soot box 18 to a terminal end of the soot collector 44.

As shown in FIGS. 2 and 3, the complete combustion functional block 500 comprises a secondary combustion chamber 51 with a predetermined size for receiving the unburned gas from the primary combustion chamber 21, and a secondary air supplier 26 for supplying a sufficient amount of air to the secondary combustion chamber 51 to cause complete combustion.

FIGS. 2 and 3 are different from each other in the positional relationship between the primary and secondary combustion chambers 21 and 51. More specifically, in FIG. 3, the constituent elements of the respective functional blocks are arranged independently, while in FIG. 2, the secondary combustion chamber 51 is partially included in the primary combustion chamber 21, and the wall of the secondary combustion chamber 51 is partially used as part of the wall of the first combustion chamber 21. This wall serves as a heat exchange wall for recovering combustion heat of the primary combustion chamber 21, thus contributing to improvement in combustion efficiency.

When the wall of the primary combustion chamber 21 is partially cut out to mount a window 16 made of a transparent refractory material, the radiant heat from the luminous flame generated during incomplete combustion can be utilized to improve heater efficiency.

Figure 9:
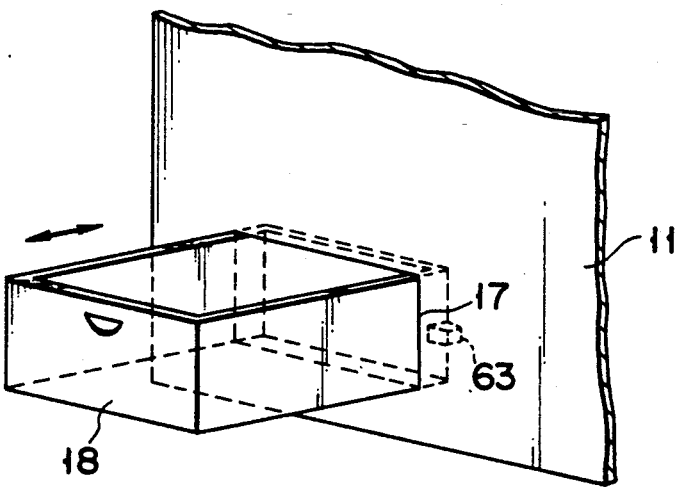
FIG. 9 is a perspective view of a vicinity of the mount section of a soot box for collecting soot provided to the same.

The room heater 1 of FIG. 1 has a box 11 with a small depth and a width slightly larger than the height. An inlet port 13 is formed in the lower portion of the front wall of the box 11 to draw room air, as indicated by a thick arrow 12 in FIG. 1. An outlet port 15 is formed in the upper portion of the front wall of the box 11 to discharge heated air into the room, as indicated by a thick arrow 14 in FIG. 1. An opening is formed at a portion of the front wall of the box 11 between the inlet and outlet ports 13 and 15. This opening is closed with the window panel 16 made of, e.g., transparent glass plate. A rectangular opening 17 is formed in the lower left corner (in FIG. 1) of the front wall of the box 11. The soot box 18 (to be described later) for recovering soot is detachably mounted to the opening 17, as shown in FIG. 9.

Figure 4:
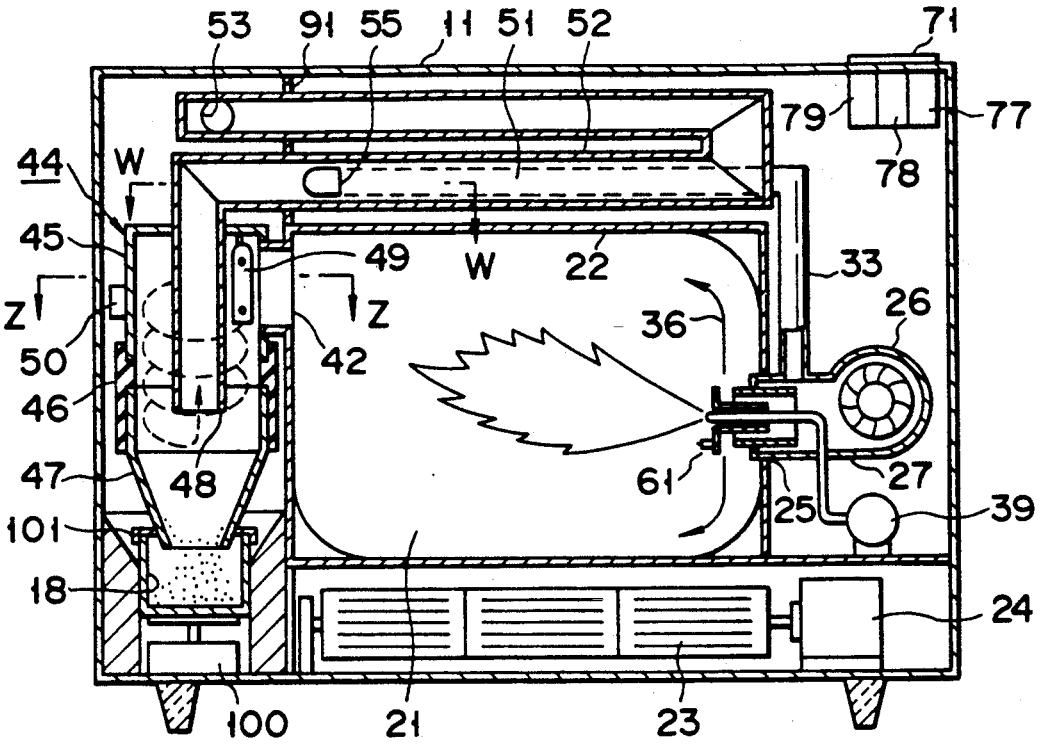
FIG. 4 is a sectional view of the same taken along the line X—X of FIG. 1.

The soot box 18 is held in position by the box driver 100 within the box 11, as shown in FIG. 4. The box driver 100 moves the soot box 18 upward to a predetermined position upon combustion operation start and moves it downward to the original position after a lapse of predetermined period of time from combustion operation stop. A seal mechanism (not shown) is provided between the periphery of the soot box 18 and the periphery of the opening 17 to ensure air tightness. A position sensor 63 is provided to a vicinity of the opening 17 to detect whether or not the soot box 18 is correctly mounted.

Figure 5:
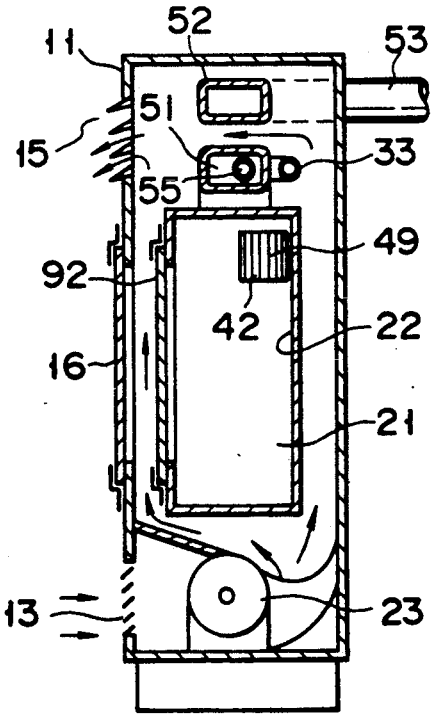
FIG. 5 is a sectional view of the sam taken along the line Y—Y of FIG. 1.

Elements shown in FIGS. 4 and 5 are housed in the box 11. Namely, a combustion box 22 is arranged at the central portion of the box 11 to define the primary combustion chamber 21. A sirocco fan 23 and a motor 24 for driving the fan 23 are arranged under the combustion box 22. The sirocco fan guides room air, taken through the inlet port 13, to the outlet port 15 through the space defined between the rear wall of the combustion box 22 and the rear wall of the box 11 and the space defined between the front wall of the combustion box 22 and the front wall of the box 11.

A hole 25 is formed in a side wall of the combustion box 22 opposite to the side where the soot box 18 is located. A blow cylinder 27 of a cross current-type fan 26 for supplying air necessary for combustion is hermetically fitted in the hole 25. The inlet port of the fan 26 is connected to one end of an air supply pipe 28 hermetically extending through the rear wall of the box 11, as shown in FIG. 1. The other end of the air supply pipe 28 communicates with the outside of the room to receive outer air.

Figure 6:
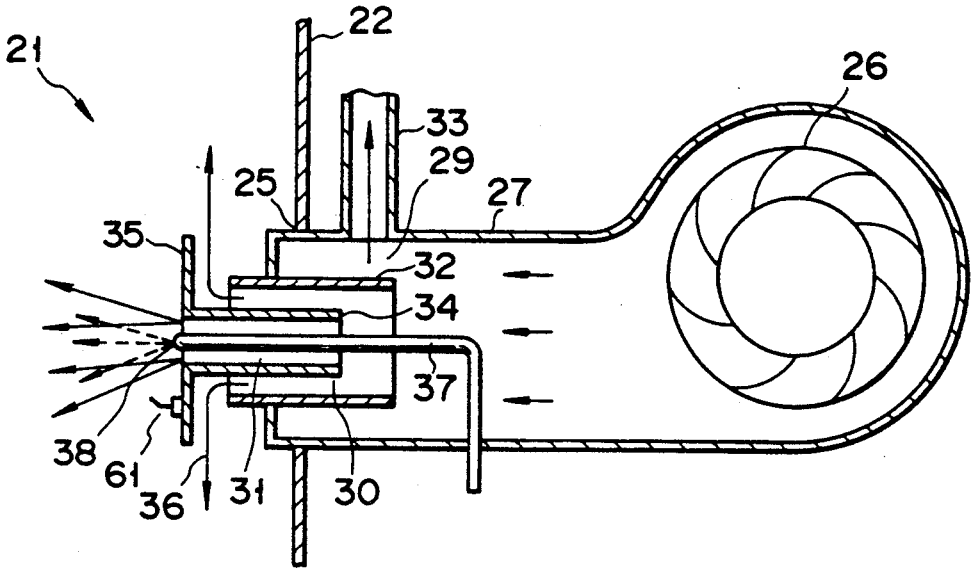
FIG. 6 is an enlarged sectional view of an air supplier of the same.

The interior of the blow cylinder 27 of the fan 26 is divided into three flow paths 29, 30 and 31, as shown in FIG. 6. The flow path 29 is defined between the blow cylinder 27 and a cylinder 32 arranged within and coaxial with the blow cylinder 27. The flow path 2 is connected to one end of a piping 33. The piping 33 supplies secondary air to the secondary combustion chamber 51 to be described later. The flow path 30 is defined between the cylinder 32 and a cylinder 34 arranged within and coaxial with the cylinder 32. The flow path 31 is the space inside the cylinder 34. A flange 35 is formed at an end of the cylinder 34 located inside the combustion chamber 21. Because of the presence of the flange 35, air blown through the flow path 30 is switched in radial directions indicated by solid lines 36 in FIG. 6 and flows along the inner surface of the combustion box 22. Air flowing through the flow path 31 is blown directly into the combustion chamber 21. An igniter 61 and a flame sensor (not shown) are mounted on the flange 35.

A fuel pipe 37 is arranged inside the cylinder 34 to extend along the axis of the cylinder 34. A nozzle 38 is mounted on one end of the fuel pipe 37, located on the combustion chamber 21 side, to inject kerosene in the form of spray. As the nozzle 38, a nozzle having a comparatively poor characteristic of spray is intentionally adopted. The other end of the fuel pipe 37 is connected to a pump 39 by extension through the outer wall of the blow cylinder 27, as shown in FIG. 4. The inlet port of the pump 39 is connected to a fuel pipe 62 by hermetical penetration through the rear wall of the box 11, as shown in FIG. 1. The fuel pipe 62 is connected to a kerosene tank (not shown) through a solenoid valve 40 and a manual control valve 41, as shown in FIG. 1.

An opening 42 is formed in an upper portion of the side wall of the combustion box 22 on the soot box 18 side, as shown in FIG. 4. The opening 42 communicates with the upper portion of the cyclone dust collector 44 through a connection cylinder 43, as shown in FIG. 7.

The cyclone dust collector 44 comprises, as shown in FIG. 4, a first bottomed cylinder 45, a second cylinder 47, and a gas guide cylinder 48. The first bottomed cylinder 45 is arranged to open downward. The second cylinder 47 is connected to the lower end of the first cylinder 45 to be coaxial with the cylinder 45 through a connection cylinder 46 made of an insulating material. The gas guide cylinder 48 extends through a so-called central portion of the bottom of the first cylinder 45, and its lower end extends to the vicinity of the upper end of the second cylinder 47. The upper interior portion of the first cylinder 45 communicates with the combustion chamber 21 through the connection cylinder 43 described above. The second cylinder 47 is tapered downward. The lower end opening of the second cylinder 47 is located above the soot box 18 mounted inside the box 11. A fitting flange 101 made of an insulating material is mounted on an outer surface of the lower end of the second cylinder 47 to hermetically fit in the opening end of the soot box 18 when the soot box 18 is moved upward by the box driver 100.

Figure 7:
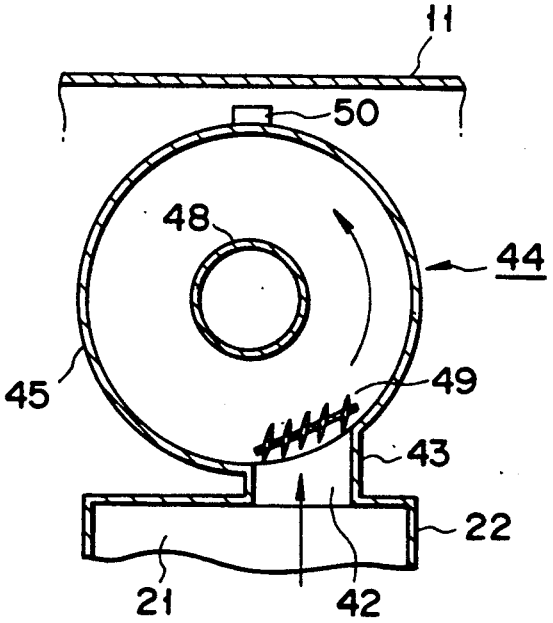
FIG. 7 is a sectional view of the same taken along the line Z—Z of FIG. 4.

A swirl vane is arranged inside the first cylinder 45 at a position opposing the opening 42, as shown in FIG. 7, to switch the gas flow flowing through the connection cylinder 43 to a swirl flow flowing along the inner surfaces of the first and second cylinders 45 and 47. The swirl vane 49 is connected to the negative pole of a DC high voltage generator 78. The second cylinder 47 is connected to the positive pole of the DC high voltage generator 78. Namely, the swirl vane 49 and the second cylinder 47 serve as the electrodes of an electrostatic dust collector. A vibrator 50 is mounted on the outer surface of the first cylinder 45 for selectively vibrating the first cylinder 45, the connection cylinder 46, and the second cylinder 47 constituting the cyclone dust collector 44.

Figure 8:
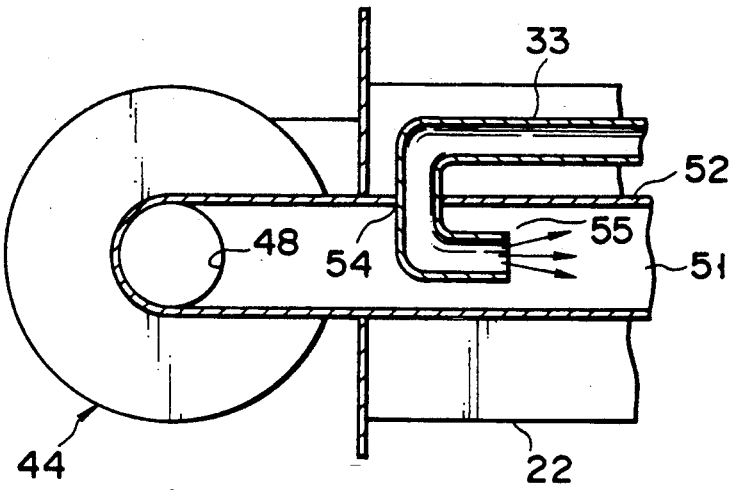
FIG. 8 is a sectional view of the same taken along the line W—W of FIG. 4.

The upper end opening of the gas guide cylinder 48 communicates with the secondary combustion chamber 51. The secondary combustion chamber 51 comprises a combustion pipe 52 that extends along the upper wall of the combustion box 22 and folds back to extend to a portion above the gas guide cylinder 48. The terminal end of the combustion pipe 52 communicates with an exhaust pipe 53 which hermetically extends through the rear wall of the box 11. A hole 54 is formed in the upstream wall of the combustion pipe 52, as shown in FIG. 8. The other end of the piping 33 is hermetically inserted in the hole 54, The piping 33 is inserted in the hole 5 with its opening 55 facing downstream.

The amount of air supplied to the first and second combustion chambers 21 and 51 will be described.

As is understood from the above description, the air flows supplied to the combustion chambers 21 and 51 are obtained by dividing the air flow supplied by the fan 26 into the flow paths 29, 30, and 31. In this embodiment, the dividing ratio of the flow paths 29, 30, and 31 is set such that the excess air ratio at the central portion of the primary combustion chamber becomes about 0.5 by the air flow flowing out from the flow path 31, the excess air ratio around the primary combustion chamber 21 becomes about 1.1 by the air flow flowing out from the flow path 30, and the excess air ratio in the secondary combustion chamber 11 becomes about 1.5

(but above the combustibility limit) or more by the air flow flowing through the piping 33.

A control panel 71 is mounted on the corner of the upper wall of the box 11, as shown in FIG. 1. A switch 72 for turning on/off the power source is provided on the control panel 71. When the switch 72 is turned on, the operation of the combustion system is automatically controlled in accordance with a predetermined sequence (by a controller to be described later). Manual control switches such as switches 73, 74, 75, and 76*a* to 76*c* are also provided. When the respective sensors for automatic control breakdown, the switch 73 is operated to stop the fan 26, thereby ensuring operation safety. The switch 74 is operated to open/close the solenoid valve 40. The switch 75 is operated to stop the pump 39. The switches 76*a* to 76*c* are operated to switch the rotating speed of the motor 24, thereby switching the air flow rate of the sirocco fan 23. These switches are used only when the sequence runs away out of control. These switches comprise push-push type switches with display functions.

A power source circuit 77, the DC high voltage generator 78, and a controller 79 are mounted on the lower surface of the upper wall of the box 11, as shown in FIG. 4. The power source circuit 77 has a circuit using a 100 V commercial AC power source and capable of obtaining a stable DC power source of several V. The DC high voltage generator 78 also uses a commercial AC power source to generate a DC voltage of 10,000 V. The controller 79 has a microprocessor as its main element.

Figure 10:
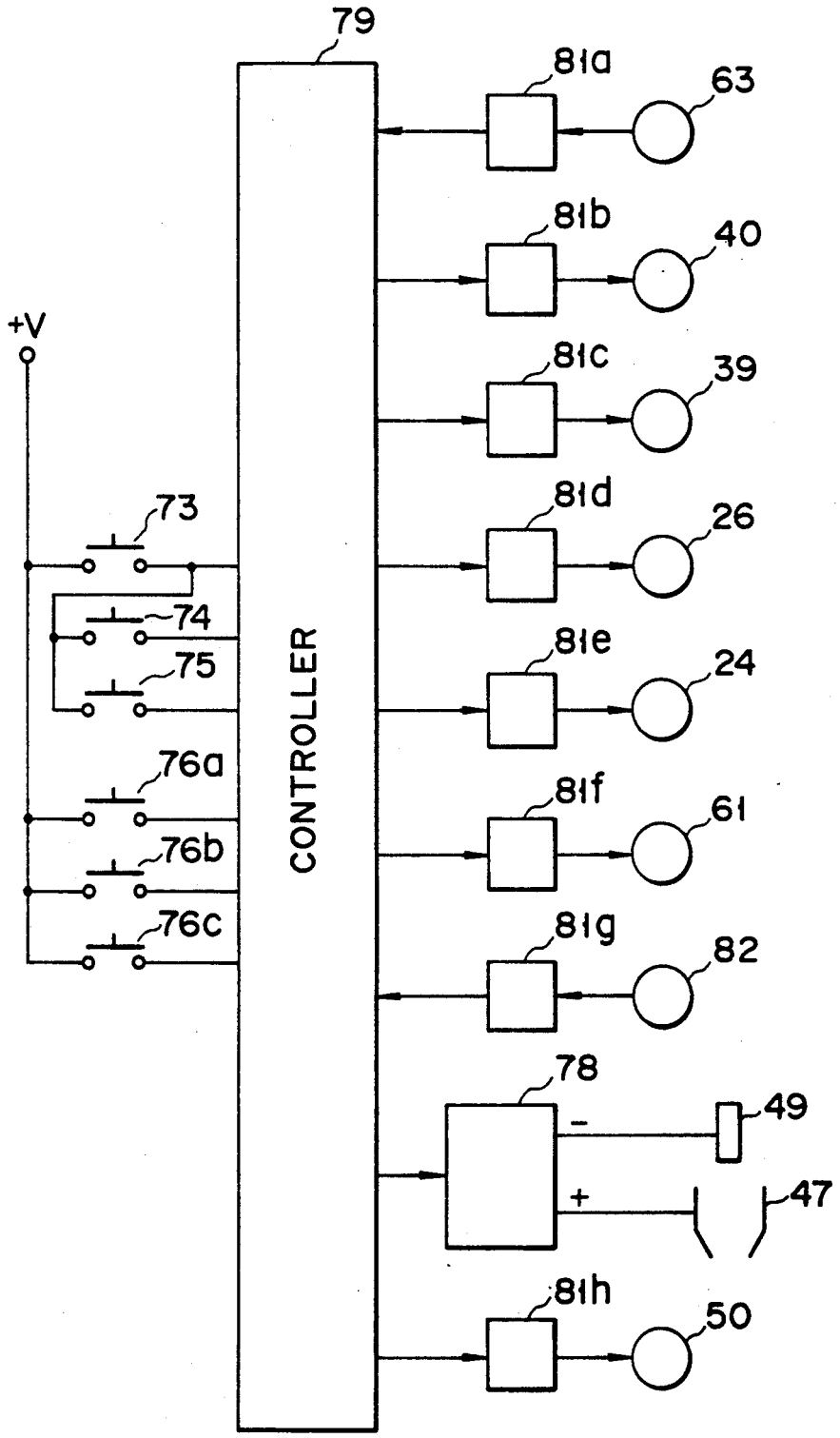
FIG. 10 shows the configuration of an electronic controller incorporated in the same.
Figure 11:
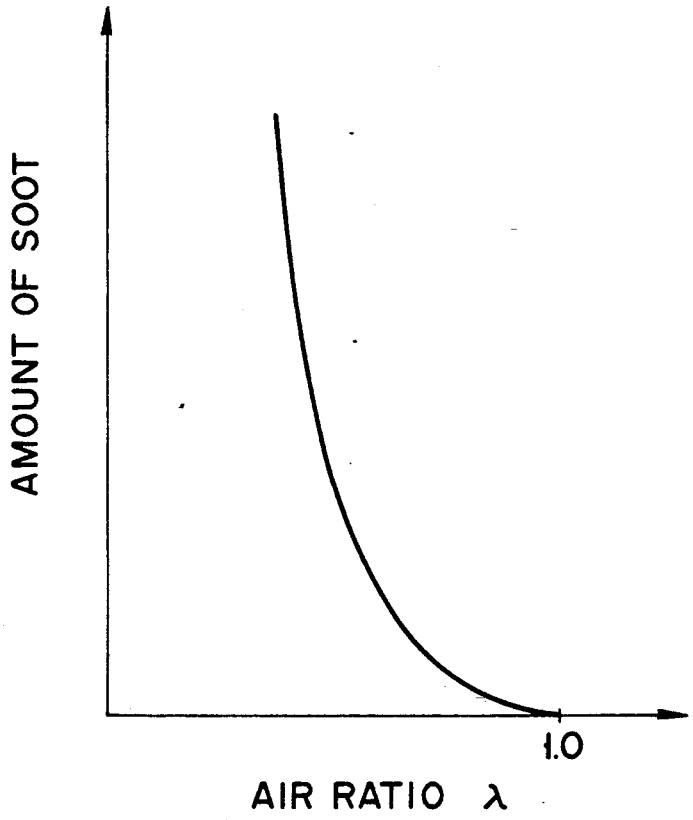
FIG. 11 is a graph showing the relationship between the excess air ratio and the soot generation amount.

The controller 79, the switches 73 to 75 and 76*a* to 76*c*, the solenoid valve 40, the pump 39, the motor 24 of the fan 26, the igniter 61, the position sensor 63, the vibrator 50, and the DC high voltage generator 78 are electrically connected to each other as shown in FIG. 10. Referring to FIG. 10, reference numerals 81*a* to 81*h* denote separators for separating the power lines and the signal lines; and 82, a flame sensor for detecting the presence of the flame in the combustion chamber 21.

The function of the controller 79 will be described.

The controller 79 controls the respective constituent elements only while a signal representing that the soot box 18 is correctly fitted in the predetermined position is supplied from the position sensor 63. During combustion, a stopper prevents the soot box 18 from being erroneously taken out. However, if the soot box 18 has been taken out for some reason, or if the soot box 18 is not mounted, the controller 79 immediately stops the operation of the respective constituent elements.

The solenoid valve 40 and the pump 39 are electrically designed to operate only when a predetermined period of time elapses after the fan 26 is set in a controlled state (enabled). The igniter 61 is operated for a predetermined period of time after the pump 39 is set in a controlled state (enabled). When no output is received from the flame sensor 82 during this period of time, operation of all the elements is stopped, and an alarm signal is generated. In this case, the system cannot be restarted if the switch 72 is not turned off. While the pump 39 is operated, a DC high voltage is output from the DC high voltage generator 78. When the pump 39 is stopped and a predetermined period of time elapses, the vibrator 50 is biased for a predetermined period.

Referring to FIG. 4, reference numeral 91 denotes a partition wall for sealing off the space where the cyclone dust collector 44 is provided in case the sealing (shield) performance for keeping the air tightness between the soot box 18 and the second cylinder 47 is degraded. Referring to FIG. 5, reference numeral 92 denotes a glass window panel provided in the front wall of the combustion box 22 in order to dissipate the radiant heat of the luminous flame when soot is burned in the combustion box 22.

The operation of the room heater 1 having the above arrangement will be described.

Assume that the manual control valve 41 is opened and that the power switch 72 is turned on. Then, as shown in FIG. 4, the soot box 18 is urged upward by the box driver 100 toward the fitted flange 101 mounted on the second cylinder 48, and is held in the fitting position with the fitted flange 101. Thus, the upper end opening of the soot box 18 becomes hermetic with the second cylinder 47. The fan 26 starts rotation to supply air to the primary and secondary combustion chambers 21 and 51 through the flow cylinder 27. The gas present in the first and second combustion chambers 21 and 51 is prepurged by the supplied air.

Then, when a predetermined period of time elapses after the fan 26 is turned on, the solenoid valve 40 is opened and the pump 39 starts rotation. Simultaneously, the igniter 61 operates. The DC high voltage generator 78 applies a DC high voltage to the swirl vane 49 and the second cylinder 47 to set the second cylinder 47 side to be electrically positive. Upon this voltage application, a glow discharge occurs between the swirl vane 49 and the second cylinder 47.

When the pump 39 starts rotation, the nozzle 38 injects kerosene into the primary combustion chamber 21 in the form of spray, and the igniter 61 ignites the fuel spray. The flame sensor 82 detects whether the ignition has been performed or not. If ignition is not performed within a predetermined period of time, all the control described above is forcibly stopped.

Then, when it is confirmed that ignition is performed normally, combustion starts in the primary combustion chamber 21. In this case, however, only a small amount of air of an excess air ratio of about 0.5 is supplied to the central portion of the primary combustion chamber 21 through the flow path 31. As a result, the combustion in the primary combustion chamber 21 becomes incomplete combustion. Thus, most of the carbon component contained in the kerosene becomes soot. The soot partially tends to attach the inner surface of the combustion box 22. However, in this embodiment, the air flow along the inner surface of the combustion box 22 is forcibly made by the flow path 30, as indicated by the solid arrows 36 in FIG. 6, and the excess air ratio of the air flow not directly contributing to combustion is set at about 1.1. As a result, soot does not attach the inner surface of the combustion box 22.

The unburned gas containing soot flows to an upper portion of the space in the cyclone dust collector 44 through the opening 42 formed in the side wall of the combustion box 22 and the connection cylinder 43. In this case, since glow discharge occurs between the swirl vane 49 and the second cylinder 47, soot is negatively charged when it passes through the vane members of the swirl vane 49. Since the unburned gas containing soot easily swirls along the inner surface of the cyclone dust collector 44 by the operation of the swirl vane 49, it flows downward while swirling in the cyclone dust collector 44. Soot shifts toward the inner circumference of the cyclone dust collector 44 by the centrifugal force caused by swirling. Since soot is negatively charged, it also shifts to the side of the second cylinder 47 which is the positive pole. As a result, soot finally falls due to the gravitation into the soot box 18 and is accumulated. In other words, most of the carbon component contained in the kerosene as the fuel is converted into soot, and most of the soot is recovered in the soot box 18.

Meanwhile, the unburned gas, from which most of the soot is separated, moves upward within the gas guide cylinder 48 and flows into the secondary combustion chamber 51. Clean air (secondary air) is supplied to the secondary combustion chamber 51 through the piping 33 at an excess air ratio of about 1.5. Therefore, the unburned gas flown into the secondary combustion chamber 51 can be perfectly burned. The exhaust gas generated by the complete combustion is discharged to outside the room through the exhaust pipe 53.

A small amount of carbon dioxide is contained in the exhaust gas discharged outside the room. However, since most of the carbon component contained in the kerosine as the fuel has been recovered in the form of soot, the content of the carbon dioxide in the exhaust gas discharged outside the room is decreased. As a result, despite that kerosene is used as the fuel, the discharge amount of carbon dioxide is decreased to half or less than that (e.g., third quarter).

Combustion in the primary combustion chamber 21 is incomplete combustion, and its combustion temperature is low. Therefore, substantially no nitrogen oxides ($NO_x$) are generated by the primary combustion. On the other hand combustion in the secondary combustion chamber 51 is performed with a high excess air ratio of about 1.5. Therefore, generation of nitrogen oxides is suppressed also in the secondary combustion chamber 51. Accordingly, the content of the nitrogen oxides in the exhaust gas discharged outside the room can be decreased to half or less than that.

When the air flow rate of the sirocco fan 23 is switched during a predetermined control sequence, the motor 24 is driven at a selected appropriate rate, and accordingly the sirocco fan 23 starts rotation. Air in the room is taken into the box 11 through the inlet port 13 by the rotation of the sirocco fan 23. The air then is blown by the sirocco fan 23 to flow upward through a space defined between the rear wall of the combustion box 22 and the front wall of the box 11 and a space defined between the front wall of the combustion box 22 and the rear wall of the box 11, contacts the outer surface of the combustion pipe 52, and is discharged into the room through the outlet port 15. Except for the initial state, the front and rear walls of the combustion box 22 are already heated by the primary combustion, and similarly the combustion pipe 52 is also preheated by the secondary combustion. Therefore, air heated by the excess heat is discharged from the outlet port 15. Since incomplete combustion occurs in the primary combustion chamber 21, as described above, soot is generated and floats as it glitters in the form of luminous flame. Radiant heat of the luminous flame is collected by radiant heat transfer to the window panel 92 in the front wall of the combustion box 22 and the window panel 16 of the box 11. If the panels 92 and 16 are refractory glass or the like, the collected radiant heat is transferred to the front surface of the room heater 1 as the combustion system of the present invention through the panels 92 and 16. Since the radiant heat is discharged from the window panel 16, a good thermal efficiency of the heater is obtained.

When the heater operation is stopped, i.e., when the switch 72 is manually turned off, the fan 26 and the pump 39 are stopped, and simultaneously the solenoid valve 40 is also closed. As the pump 39 is stopped, the output from the DC high voltage generator 78 becomes zero. The vibrator 50 is biased for a predetermined period of time when the pump 39 is stopped and a predetermined period of time elapses. The cyclone dust collector 44 is vibrated by this biasing to recover most of the soot attached on the inner surface of the collector 44 into the soot box 18. When biasing to the vibrator 50 is stopped and a predetermined period of time elapses, the box driver 100 moves downward the soot box 18 to a position to face the opening 17 to release the hermetic state. Therefore, for disposing soot, the user only needs to manually withdraw the soot box 18 while the system does not perform heating, and to dispose the collected soot.

In the above embodiment, the present invention is applied to a room heater. However, the present invention is not limited to this specific heater, but can be applied to combustion systems at large, e.g., a water heater, a heat source for the regenerator of an absorption refrigerating machine, a generator boiler, and an industrial boiler, that use a hydrocarbon-based fuel.

The excess air ratio for the primary combustion may preferably be the limits of inflammability to less than 1.0, and that for the secondary combustion may preferably be 1.2 to about 2.0. As in the embodiment, the excess air ratio of the air flow that flows along the inner surface of the combustion box for the purpose of cleaning the wall may preferably be 1.2 to about 2.0. When a hydrocarbon-based gas fuel is used, the flame during the primary combustion may be adjusted to be long to promote soot generation. When a hydrocarbon-based liquefied fuel is used, not only a pressure jet burner but also an evaporation type or a pot type fuel supplier may be used instead.

As has been described above, according to the present invention, a combustion system is provided that can greatly reduce the exhaust amount of a toxic gas, e.g., carbon dioxide, to half or less than that even if it used a hydrocarbon-based fuel, thus contributing to environmental preservation.

Additional advantages and modifications will readily occur to those skilled in the art. Therefore, the invention in its broader aspects is not limited to the specific details, and representative devices, shown and described herein Accordingly, various modifications may be made without departing from the spirit or scope of the general inventive concept as defined by the appended claims and their equivalents

What is claimed is:

1. A combustion system for burning a hydrocarbon-based fuel, comprising:

means for imperfectly combusting the fuel by supplying a predetermined amount of air;

means, connected to said incomplete combustion means, for removing a solid component in an unburned gas generated by said incomplete combustion means; and means for perfectly burning a remaining unburned gas by supplying a predetermined amount of air, the remaining unburned gas being obtained by removing the solid component from the unburned gas by flowing the unburned gas through said solid component removing means;

wherein said incomplete combustion means comprises a primary combustion chamber having a predetermined size of space for burning the fuel, fuel supplying means for supplying the hydrocarbon-based fuel into said primary combustion chamber in accordance with a consumption amount thereof, and first air supplying means for continuously supplying to said primary combustion chamber a predetermined amount of air sufficient for realizing incomplete combustion of the fuel;

wherein said solid component removing means comprises soot collecting means for collecting, by converting into a form of dust, soot within the solid component contained in the unburned gas generated by said primary combustion chamber, a soot box, detachably mounted on an opening of a main body of said combustion system, for recovering the soot by accumulating the soot in the form of dust, a soot box driver for selectively moving said soot box with respect to a terminal end of said soot collecting means and to hermetically mount said soot box thereto, and a hermetic seal portion, provided between the terminal end of said soot collecting means and said soot box, for keeping air tightness of a coupled portion upon mounting; and wherein said complete combustion means comprises a secondary combustion chamber having a predetermined size of space for introducing therein the unburned gas supplied through said solid component removing means and for burning the unburned gas, and second air supplying means for supplying into said secondary combustion chamber air of an amount sufficient for realizing complete combustion, thereby further burning the unburned gas.

2. A combustion system according to claim 1, wherein:

said soot collecting means comprises a first bottomed cylinder arranged with an opening facing downward, a connection cylinder made of an insulating material and arranged under said first cylinder, a second cylinder coaxially connected through said first cylinder, a gas guide cylinder which extends through a central portion of a bottom of said first cylinder and which has a lower end extending to a vicinity of an upper end of said second cylinder, and a vibrator for selectively vibrating said first cylinder, said connection cylinder, and said second cylinder;

said soot collecting means serves as a cyclone dust collector utilizing a centrifugal force generated upon swirling of a gas fluid flowing in said first cylinder, and also as an electrostatic dust collector comprising a direct current high voltage generator for supplying electricity for generating glow discharge, and a swirl vane connected to a negative pole of said generator and arranged at a predetermined position of said first cylinder to be directed in the direction of tangent to an outer wall of said gas guide cylinder; and said soot collecting means separates and collects the solid component mixed in the gas fluid.

3. A combustion system according to claim 2, wherein, when the unburned gas is caused to flow into an upper space in said soot collecting means and to pass between vane elements of said swirl vane, said soot collecting means causes glow discharge between said swirl vane and said second cylinder to negatively charge the soot, and applies a swirling flow to the soot so that the soot flows downward along inner surface of said soot collecting means, and positively charges said second cylinder, thereby guiding the soot to the side of said second cylinder and causing the soot to fall onto and accumulate in the vicinity of a central portion of said soot box.

4. A combustion system according to claim 2, wherein said soot collecting means comprises a dust collector employing both a static dust collecting method and a cyclone dust collecting method.

5. A combustion system according to claim 2, wherein part of a wall constituting said primary and secondary combustion chambers also serves as a heat exchange wall for recovering combustion heat generated in said primary and secondary combustion chambers.

6. A combustion system for burning a hydrocarbon-based fuel, comprising:

a primary combustion chamber;

means for supplying fuel at a controlled rate to said primary combustion chamber;

means for supplying a first predetermined amount of air to said primary combustion chamber at a controlled rate, said first predetermined amount of air being insufficient to achieve complete combustion of said fuel, resulting in the production of an unburned gas having a large solid component content;

means, receiving said unburned gas from said primary combustion chamber, for removing said solid component from said unburned gas;

a secondary combustion chamber receiving said unburned gas from said solid component removing means; and means for supplying a second predetermined amount of air to said secondary combustion chamber at a controlled rate, said second predetermined amount of air being sufficient to achieve complete combustion of said unburned gas.

7. A combustion system according to claim 6, wherein:

said first predetermined amount of air supplies an excess air ratio of less than 1.0 with respect to said fuel supplied to said primary combustion chamber; and said second predetermined amount of air supplies an excess air ratio of not less than 1.0 with respect to carbon monoxide within said unburned gas received by said secondary combustion chamber from said solid component removing means.

8. A combustion system according to claim 6, wherein said primary combustion chamber further comprises a window made of a transparent refractory material allowing a radiant heat radiated by a luminous flame in said primary combustion chamber to pass therethrough, thereby transmitting the radiant heat to the outside of said combustion system.

9. A combustion system according to claim 6, further comprising a fan, said fan supplying said first predetermined amount of air to said primary combustion chamber by way of a first flow path, and said fan supplying said second predetermined amount of air to said secondary combustion chamber through a second flow path.

* * * * *

UNITED STATES PATENT AND TRADEMARK OFFICE

CERTIFICATE OF CORRECTION

PATENT NO. : 5,144,941

DATED : September 8, 1992

INVENTOR(S) : Toshihiko Saito et al.

It is certified that error appears in the above-identified patent and that said Letters Patent is hereby corrected as shown below:

On Title page, Item [30], Foreign Application Priority Data, has been omitted, should read as follows:

--Mar. 30, 1990 [JP] Japan.....2-81359--.

Signed and Sealed this

Nineteenth Day of October, 1993

*Attest:*

*Attesting Officer*

BRUCE LEHMAN

*Commissioner of Patents and Trademarks*